US006308828B1

(12) United States Patent
Jones

(10) Patent No.: US 6,308,828 B1
(45) Date of Patent: Oct. 30, 2001

(54) PACKAGE KIT AND METHOD

(75) Inventor: W. Charles Jones, Osterville, MA (US)

(73) Assignee: Emerging Technologies Trust, Osterville, MA (US)

( * ) Notice: Subject to any disclaimer, the term of this patent is extended or adjusted under 35 U.S.C. 154(b) by 0 days.

(21) Appl. No.: 09/580,012

(22) Filed: May 26, 2000

(51) Int. Cl.[7] ..... B65D 69/00; B65D 73/00; B65D 81/02

(52) U.S. Cl. ..... 206/223; 206/485; 206/583

(58) Field of Search ..... 206/485, 583, 206/223, 305, 320, 576, 591–594, 521

(56) References Cited

U.S. PATENT DOCUMENTS

Re. 36,412 11/1999 Jones .
5,323,896 6/1994 Jones .
5,341,931 * 8/1994 Prochaska et al. ..... 206/485
5,678,695 10/1997 Ridgeway et al. .
5,765,693 * 6/1998 Gnadt et al. ..... 206/485
5,975,294 * 11/1999 his-Chang ..... 206/485
5,975,307 * 11/1999 Harding et al. ..... 206/583

* cited by examiner

*Primary Examiner*—Luan K. Bui
(74) *Attorney, Agent, or Firm*—Leslie Meyer-Leon, Esq.; IP Legal Strategies Group P.C.

(57) ABSTRACT

A package kit to immobilize and package an article, which kit comprises a sheet material with a base portion for the article and a film tube. The sheet material has fold lines to provide for box sections at each end, which are arranged and constructed to move between a planar, nonuse position and a raised, use position to retain an article there between and on the surface of the film material of the film tube.

24 Claims, 5 Drawing Sheets

PACKAGE KIT AND METHOD

BACKGROUND OF THE INVENTION

Package kits and systems are employed to package articles, particularly, odd-shaped or fragile articles within a container.

One package kit and system, known as a TURTLE PAK® kit (a registered trademark of Emerging Technologies Trust of Osterville, Mass.), employs a stiff sheet material having a base portion to hold the article, at least one longitudinal fold line, and a pair of opposite, foldable end panels, and employs a polymeric film tube. The film tube extends about or over the base portion and is moved on movement of the end panels between a loose article insertion position and a huggable article-immobilizing position (see, for example, U.S. Pat. No. 5,323,896, issued Jun. 28, 1994, and its Reissue U.S. Pat. No. 36,412, issued Nov. 30, 1999, hereby incorporated by reference). Other package kits which employ a film tube which is formed by adhesively securing a portion of a polymeric film over the base portion are described in U.S. Pat. No. 5,678,695, issued Oct. 21, 1997, which is also hereby incorporated by reference.

It is desirable to provide a new and improved package kit and method which employs a film tube together with a foldable base sheet to retain and package articles.

SUMMARY OF THE INVENTION

The invention relates to a package kit, system and method to retain an article for packaging on a base portion of a foldable sheet material.

The invention comprises a single sheet of stiff material, typically rectangular, having a one end and an other opposing end, opposing sides, and a back and front surface, the sheet material having a generally central base portion to receive and package an article. The sheet material is characterized by a plurality of three or more parallel, spaced-apart fold lines at each end to form a plurality of foldable end flaps, the last end flap folded over and adhesively or otherwise secured to the back surface of the sheet material. The end flaps are arranged and constructed to move between a flat, generally planar, nonuse position and an upright, generally perpendicular, use position, to form a raised box section at each end, and optionally, with an interior face opening, typically, a rectangular opening extending generally the length and height of the box section. In one embodiment, the opening is selected, arranged, and constructed to retain the opposing ends of an article to be packaged therein. The interior face opening may vary in shape or dimensions, as desired, e.g., rectangular, square, oval, etc. and may mimic the ends of the article. Where a rectangular article, like a book or book-like shaped object is to be packaged, the opening may mimic the end shape of the article, to receive slightly the ends of the article in the openings. The top or other section of the box section may have one or more openings or tabs to aid a user in lifting the box section to the use position.

The kit may include a film tube as a separate preformed and surrounding film tube fitting loosely about the front and back surface of the base portion and extending at least the length of the base portion, and typically, slightly greater. The film tube is preferred, since the film tube formed tube and sheet material may be easily separated for recycling or reuse. The film tube may also be formed by securing a film material over only the front surface of the base portion and then adhesively, or otherwise, securing the side edges of the film material to the opposing side, front surface edges of the base portion, or extending the film material and adhesively, or otherwise, securing the folded-over side edges to the back surface of the base portion to form an in situ film tube. When the box sections are raised to a use position, the opposing ends of the film tube are raised and stretched by the box sections and aid in holding the article in position.

The film material comprises one or more overlapping layers of a thin polymeric film material, which is stretchable when the box sections are in a use position. The film material is usually a transparent film material of 0.5 to 5 mils in thickness, but may also be a bubble wrap-type film material, i.e., a film material with a plurality of small, raised, uniform, bubbles formed of the film material. The film material may, for example, comprise an olefinic, urethane, or vinyl film material, like a polyethylene film material or a film material known as a metallocene film material, i.e., a polymer prepared by the use of a metallocene catalyst. In use, the film material is under stress and tented at each corner.

The film material, in sheet or film tube form, when employed on the top surface of the sheet material, may be preformed, for example, heat-formed or otherwise molded to mimic or be shaped in the general shape of the article to be packaged, to aid in retaining the article.

The article to be immobilized may vary in shape, weight, size, and form, and after packaging or immobilization on the base portion, may be inserted in an outer container with or without additional packaging material for transportation.

The package kit of the invention is simple, inexpensive, easily shipped and manufactured, and easily moved between a nonuse and a use position by a user. The sheet material may be prepared by die cutting and forming perforated or other transverse fold lines and an adhesive operation, while the film tube is easily prepared by heat-sealing the edges of two film materials of the same or different materials, or heat-sealing a film material to the base portion, generally where the base portion is pretreated or coated to permit heat or adhesive sealing of the film material.

The kit and method will be described for the purpose of illustration only in connection with certain embodiments; however, it is recognized that various changes, modifications, additions and improvements to the illustrated kit and method may be made by those persons skilled in the art without departing from the spirit and scope of the present invention.

DESCRIPTION OF THE EMBODIMENTS

Figure 1:
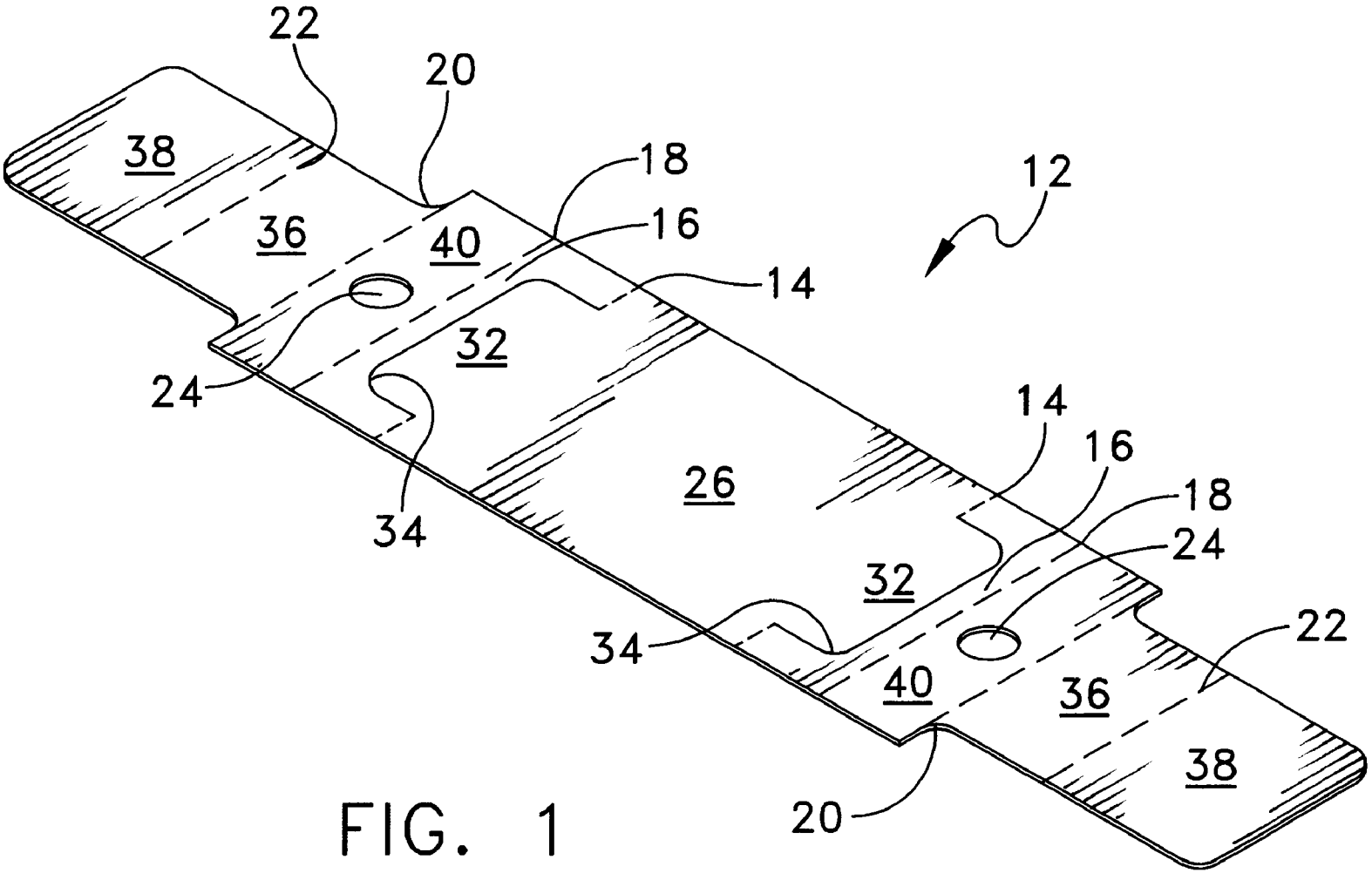
FIG. 1 is a top plan view of a sheet material of the package kit prior to assembly.

FIG. 1 is a top plan view of the unassembled stiff cardboard sheet material 12, with perforated full fold lines 18, 20, and 22 and partial fold line 14 to define end flaps 36, 38, top flap 40, and inner flap 16. The sheet material 12 defines a base section 26 and finger holes 24 in top flaps 40 (or a tabs may be used) to permit a user to move each box between a use and nonuse position. The sheet material 12 includes a generally elongated cut line 34 between the ends of partial fold lines 14, on each side, to define cut out area 32 at each end, which defines an open space on the inner flap 16 at each end in the use position.

Figure 2:
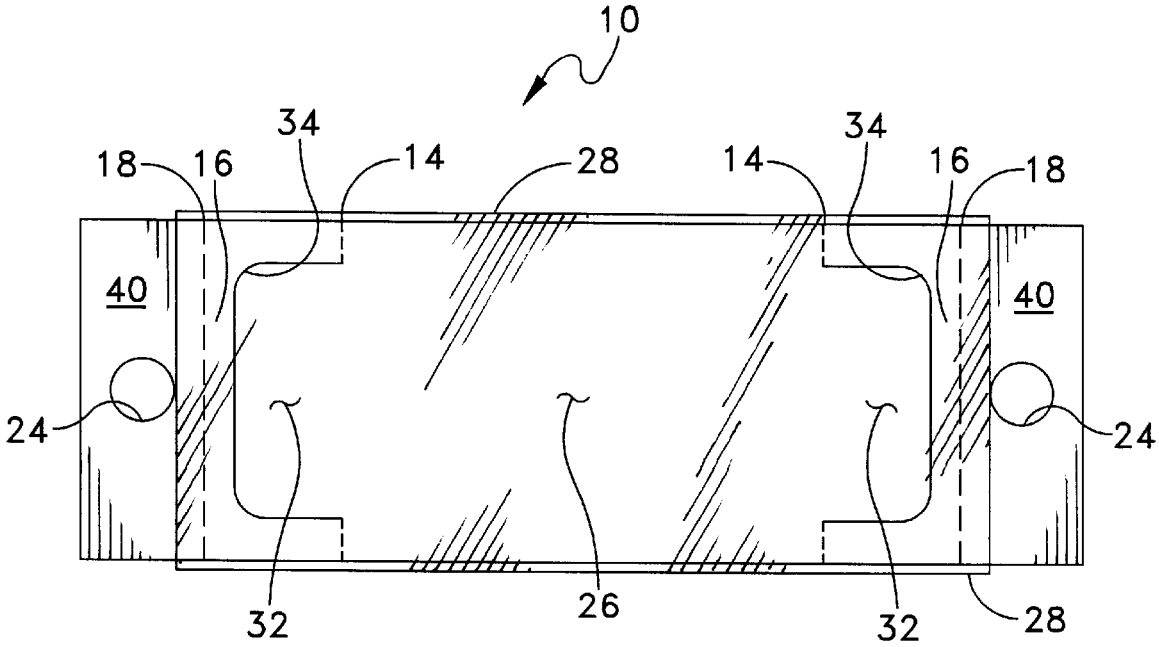
FIG. 2 is a top plan view of the assembled sheet material of FIG. 1 with a film tube.

FIG. 2 shows a top plan view of the sheet material 12 in an assembled position, for use with a film tube 28, wherein the end flaps 36 and 38 have been folded over.

Figure 3:
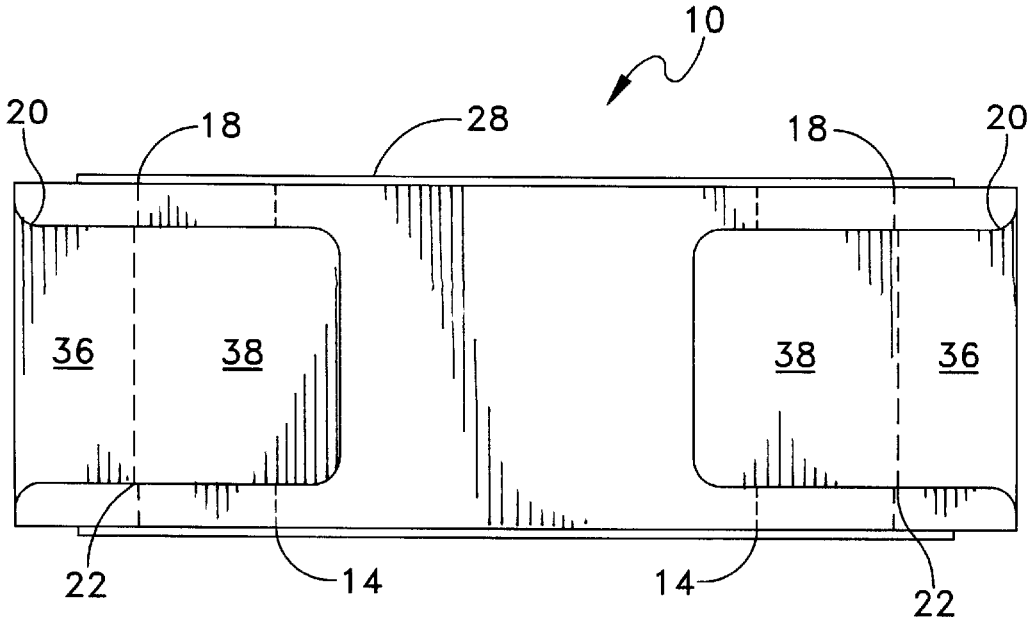
FIG. 3 is a bottom plan view of the sheet material of FIG. 2 with a film tube.

FIG. 3 shows a bottom plan view of the sheet material 12 of FIG. 2, showing the folded end flaps 36 and 38 on the back surface, with the far end of the end flap 38 adhesively secured to the back surface just beyond partial fold lines 14.

Figure 4:
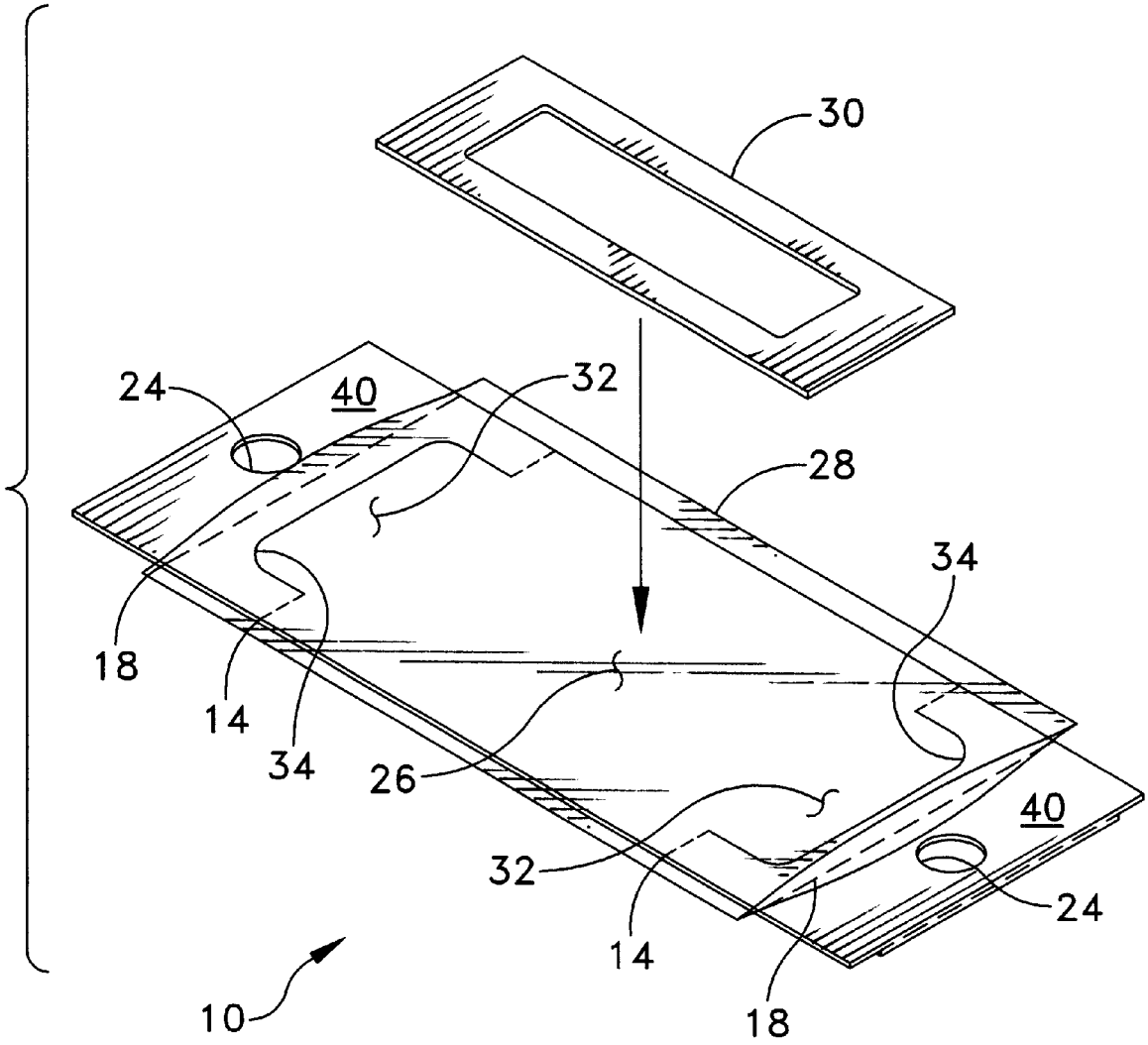
FIG. 4 is a top plan view of the package kit of the invention with an article to be packaged in a nonuse flat position.

FIG. 4 is a perspective view from above of the package kit 10 and shows the sheet material 12 of FIGS. 2 and 3 and an edge-sealed, transparent, stretchable, polyethylene, e.g., 2 mil film tube 28 surrounding the base portion 26 of the sheet material 12 and extending generally to and slightly beyond fold line 18 at each end. FIG. 4 illustrates an article 30 to be packaged in the package kit 10. The article illustrated has rectangular ends and is of a sufficient length that the ends extend slightly into the end open areas of cut area 32 in the use position. The article 30 is placed on the top surface of the film tube 28 and extends to cut area 32 at each end, prior to movement of the sheet material 12 to the use position.

Figure 5:
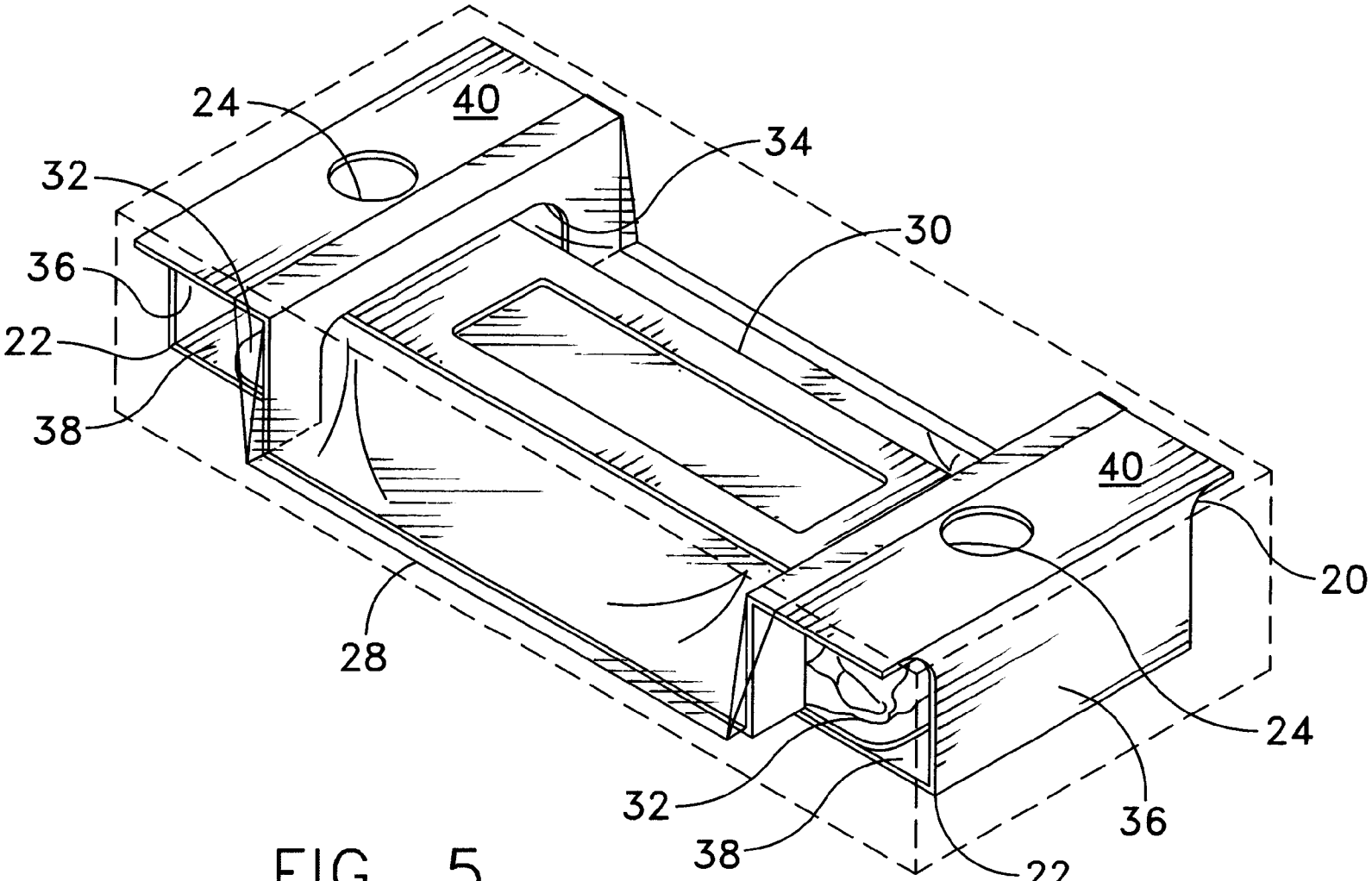
FIG. 5 is a top perspective view from above of the package kit in a use position with a packaged article.

FIG. 5 is a perspective view from above of the use position of the package kit 10 in container 42 (shown in dotted lines), with the article 30 resting on the film tube 28, which is positioned on top of the base section 26, and the ends of the film tube 28 tensioned to aid in holding the article 30 onto the base 26, with the article 30 ends in the rectangular open cut area 32 at each end.

The box sections at each end are formed by inserting a user finger into each finger hole 24 and pulling upward to raise flaps 16, 40, and 36, to form a box-like section at each end of the sheet material 12, with the finger holes 24 on the top flaps 40 and the inner flaps 16, end open spaces 32, and end flaps 36 and 38 forming the box sections.

The foldable, upright box sections so formed, tensions the film material of the film tube, or any film material of an in situ film tube, at each end and aids in retaining the article in place, and also imparts further rigidity to the sheet material and allows height end protection for the article to be packaged. While the package kit has been illustrated with box-like end sections, it is recognized that other geometric sections can be formed by the foldable ends of the sheet material, as described or required, by the dimensions and nature of the article to be packaged, such as a plastic cover, a book, a laptop computer, etc.

Figure 6:
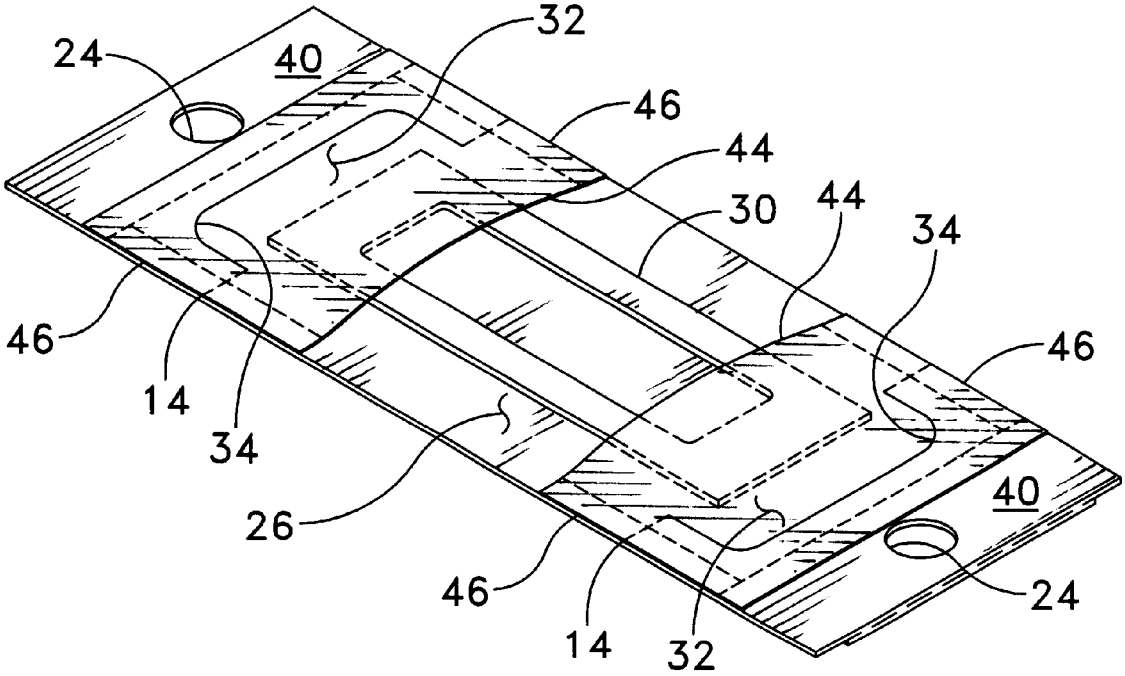
FIG. 6 is a perspective view from above of the package kit in a use position with a secured, overlay film material rather than a loose film tube.

FIG. 6 shows the use of a huggable, transparent film material 44, like polyethylene, extending over the base section 26, in a nonuse position, with the peripheral edges of the film material 44 secured to the sheet material 12 at the outer edges or to the edges of the back surface of the sheet material 12 (not illustrated), to form, e.g., adhesively, heat-sealed, or otherwise, a seal line 46. This arrangement substitutes for the loose film tube 28 of FIG. 5, but does not readily permit the kit materials to be recycled. If desired, the film material 44 need not extend the entire length of the base portion 26, but rather, extend only to and cover only the separate box-like end portions and the article 30 in cut out areas 32.

The article 30 to be packaged has been shown in FIGS. 5 and 6 as placed on top of the film material; however, the article may be placed within the loose or secured film tube prior to raising of the one and other box-like end portions. Raising the end portions then retains the article on the sheet material 12.

What is claimed is:

1. A package kit for the retention of an article to be packaged, which kit comprises:

a) a sheet material having a one end and an other end; side edges; a front surface; a back surface; and a base section to retain an article thereon, each of said one and other ends having opposing, box end sections in use, which are arranged and constructed to move between a flat, planar, nonuse position and an upright, generally perpendicular, box section use position, each end section defined by a plurality of at least three transverse, parallel, spaced-apart fold lines to form sequentially, first, second, and third end flaps at each end, a partial transverse fold line extending inwardly at each side, and a transverse cut line in the sheet material between the partial transverse fold lines to form a fourth end flap with an open area in said flap of the box end sections at each end of the base section in the use position; the one end and the other end of the sheet material having a transverse width about or less than the transverse width of the cut line, and the first end flaps folded over and secured to the bottom surface of the sheet material; and b) a film tube of a thin film material, which film tube extends over the base portion and generally between the third fold lines, whereby an article placed on the base section is retained in position on movement of the end section to a use position by the opposite ends of the article extending toward or into the open area and the article prevented from movement on the top of the film material by the tension exerted on the film material by the box sections in the use position.

2. The kit of claim 1 wherein the film tube, in a nonuse position, comprises a loosely fitted film tube of transparent, stretchable, polymeric film material which extends about the base section on the front and back surface, is open at each end, and has a longitudinal length about or greater than the length between the third fold lines.

3. The kit of claim 1 wherein the film material comprises a metallocene olefin film material.

4. The kit of claim 1 wherein the film tube comprises a film material secured to the sides or back surface of the sheet material to form a film tube.

5. The kit of claim 4 wherein the film material is adhesively secured at opposing sides on the front or back surface to the sheet material to form a film tube.

6. The kit of claim 1 wherein the box section at each end includes a finger opening to aid a user in lifting the box section to the use position.

7. The kit of claim 1 wherein the cut line at each end comprises a generally U-shaped cut line to form a generally U-shaped open area at each end.

8. The kit of claim 1 wherein the sheet material comprises a stiff cardboard sheet material, and the first flap at each end is adhesively secured to the back surface.

9. The package kit of claim 1 which includes an article retained on the base section when the box sections are in the use position.

10. A container which includes therein the retained article and package kit of claim 9.

11. A sheet material for use in a package kit, which sheet material comprises: a sheet material having a one end and an other end; side edges; a front surface and a back surface; and a longitudinal base section to retain an article thereon, each of said one and other ends having opposing, box end sections in use, which are arranged and constructed to move between a flat, planar, nonuse position and an upright, generally perpendicular, box section use position by a user, each end section defined by a plurality of three transverse, parallel, spaced-apart fold lines to form sequentially, first, second, and third end flaps and a partial transverse fold line extending inwardly at each side, a transverse cut line in the sheet material between the partial transverse fold lines to form a forth end flap with a defined open area in said flap of the box end sections at each end of the base section in the use position; the one end and the other end of the sheet material having a transverse width about or less than the transverse width of the cut line, and the first end flap secured to the bottom surface of the sheet material.

12. The material of claim 11 wherein the cut line at each end comprises a generally U-shaped open area cut line to form a lengthened U-shaped open area at each end.

13. The material of claim 11 wherein the sheet material comprises a single piece of stiff cardboard sheet material, and the first flap at each end is adhesively secured to the back surface.

14. The material of claim 11 wherein a top surface of the box section at each end includes a finger opening to aid in moving the box section between the nonuse and the use position.

15. A package kit for the retention of an article to be packaged, which kit comprises:

a) a stiff cardboard, rigid sheet material having a one and an other end, sides, a longitudinal axis, and transverse axis generally perpendicular to the longitudinal axis, and having a base section to receive and retain an article, and having a plurality of generally parallel, spaced-apart fold lines and a cut line at the one and other end to form a box section at the one and other end with a cut out area to form an open area; the box section is adapted to move between a flat, nonuse position and a use position by a user, wherein the box sections are in a raised, upright position with the open areas positioned inwardly toward the base section to retain an article between the open areas of the box sections and on the base section; and b) a polymeric, stretchable film material which extends over the front surface of the base section and extends in length beyond the box sections and the article having ends which extend into the open areas, and which article is retained in place by the tension placed on the film material in the use position.

16. The kit of claim 15 which includes a means to permit a user to move the box section between a use and a nonuse position.

17. The kit of claim 15 wherein the sheet material comprises a one flap at each end adhesively secured to a back surface of the sheet material.

18. The kit of claim 15 wherein the film material comprises a transparent, polymeric film material.

19. The kit of claim 15 wherein the box sections each comprise an outer flap, a top flap with an opening therein, and an inner flap with a shaped cut out area.

20. The kit of claim 15 wherein the open area generally mimics the shape of each end of the article to be packaged.

21. The kit of claim 15 wherein the film material is formed to mimic generally the shape of the article to be packaged.

22. The kit of claim 15 wherein the film material comprises first and second end sections, which sections extend only over the box sections at each end.

23. The kit of claim 15 which includes an article retained on the base section.

24. A container which includes the kit and article of claim 23.

* * * * *